US011828096B2

(12) United States Patent
Koenig et al.

(10) Patent No.: US 11,828,096 B2
(45) Date of Patent: Nov. 28, 2023

(54) METHOD FOR INSTALLING A GUIDE ASSEMBLY FOR A MOVABLE FURNITURE PART

(71) Applicant: Julius Blum GmbH, Hoechst (AT)

(72) Inventors: Bernd Koenig, Hoechst (AT); Matthias Rupp, Hohenweiler (AT); Thomas Sperger, Hard (AT)

(73) Assignee: Julius Blum GmbH, Hoechst (AT)

( * ) Notice: Subject to any disclaimer, the term of this patent is extended or adjusted under 35 U.S.C. 154(b) by 0 days.

(21) Appl. No.: 17/839,879

(22) Filed: Jun. 14, 2022

(65) Prior Publication Data

US 2022/0307306 A1 Sep. 29, 2022

Related U.S. Application Data

(63) Continuation of application No. PCT/AT2020/060458, filed on Dec. 11, 2020.

(30) Foreign Application Priority Data

Dec. 19, 2019 (AT) ..... GM 50233/2019

(51) Int. Cl.
*E05D 15/26* (2006.01)
*E05D 15/58* (2006.01)
(Continued)

(52) U.S. Cl.
CPC ..... *E05D 15/264* (2013.01); *E05D 13/04* (2013.01); *E05D 15/58* (2013.01); *E05F 5/003* (2013.01); *E05Y 2900/20* (2013.01)

(58) Field of Classification Search
CPC ..... E05D 15/58; E05D 15/264; E05D 13/04; E05Y 2900/212; E05F 1/16; E05F 1/08; E05F 5/00; E05F 5/003
See application file for complete search history.

(56) References Cited

U.S. PATENT DOCUMENTS 3,880,094 A * 4/1975 Kopp ..... A47B 46/00 108/74
4,729,612 A * 3/1988 Stone ..... E06B 3/5045 312/109
(Continued)

FOREIGN PATENT DOCUMENTS

AT 519897 11/2018
AT 521149 11/2019
(Continued)

OTHER PUBLICATIONS

International Search Report dated Mar. 9, 2021 in International (PCT) Application No. PCT/AT2020/060458.

*Primary Examiner* — Justin B Rephann
(74) *Attorney, Agent, or Firm* — Wenderoth, Lind & Ponack, L.L.P.

(57) ABSTRACT

A method for installing a guide assembly for a movable furniture part includes preferably carrying out chronologically in the following order: arranging on the furniture wall a first guide rail for guiding the movable furniture part, and arranging on a first elongated side of the first guide rail a drive device for influencing the movement of the movable furniture part on the furniture wall, the first guide rail and the drive device preferably being connected together. If the movable furniture part includes at least two door leaves connected together in an articulated manner, arranging a second guide rail for guiding the movable furniture part on the furniture wall on a second elongated side of the first guide rail, the first guide rail and the second guide rail preferably being connected together in a form-fitting and/or movable manner in particular.

24 Claims, 10 Drawing Sheets

(51) Int. Cl.
*E05C 17/60* (2006.01)
*E05F 5/00* (2017.01)

(56) References Cited

U.S. PATENT DOCUMENTS 4,821,375 A * 4/1989 Kozon ..... E06B 3/5045 312/331
4,976,502 A * 12/1990 Kelley ..... A47B 87/007 312/331
5,078,461 A * 1/1992 Beck ..... E06B 3/5045 312/331
5,121,976 A * 6/1992 Haab ..... E05D 15/58 49/254
5,149,180 A * 9/1992 Haab ..... E05D 15/58 312/331
5,520,451 A * 5/1996 Oshima ..... E05D 15/582 312/331
6,994,410 B2 * 2/2006 Hogan ..... E05D 15/58 312/110
7,959,242 B2 6/2011 Del Castillo
8,696,076 B2 4/2014 Karg
9,894,996 B1 * 2/2018 Grela ..... E05D 15/48
10,227,806 B2 3/2019 Gabl
10,876,340 B2 * 12/2020 Rupp ..... E06B 3/482
10,947,763 B2 3/2021 Blum et al.
11,118,386 B2 * 9/2021 Rupp ..... E05D 15/266
11,136,804 B2 10/2021 Rupp et al.
2004/0239216 A1 12/2004 Castillo
2010/0270898 A1 * 10/2010 Haab ..... E06B 3/5045 312/323
2013/0232878 A1 * 9/2013 Bortoluzzi ..... E05D 15/58 49/252
2013/0334944 A1 12/2013 Karg
2017/0241178 A1 * 8/2017 Gabl ..... E05F 1/16
2019/0301216 A1 * 10/2019 Rupp ..... E05D 15/26
2019/0330898 A1 10/2019 Rupp et al.
2020/0018106 A1 * 1/2020 Rupp ..... E05D 15/0634
2020/0018107 A1 * 1/2020 Rupp ..... E05D 15/58
2020/0048947 A1 2/2020 Blum et al.
2020/0386028 A1 12/2020 Girotto et al.
2021/0262268 A1 8/2021 Goetz
2022/0120127 A1 4/2022 Meusburger et al.

FOREIGN PATENT DOCUMENTS

AT 522708 1/2021
CN 103415671 11/2013
CN 205876062 1/2017
CN 108104648 6/2018
CN 110199081 9/2019
KR 10-2012-0028449 3/2012
WO 2016/081961 6/2016
WO 2018/129568 7/2018
WO 2018/204948 11/2018
WO 2018/204950 11/2018
WO 2019/106508 6/2019

* cited by examiner

METHOD FOR INSTALLING A GUIDE ASSEMBLY FOR A MOVABLE FURNITURE PART

BACKGROUND OF THE INVENTION

The invention relates to a method for installing a guide assembly for a movable furniture part, which comprises either precisely one door leaf or at least two door leaves connected to each other in an articulated manner, on a furniture wall of a stationary furniture part. The invention furthermore relates to a method for installing a piece of furniture in which the method for installing a guide assembly is used.

Methods are already known from the state of the art. Different guide assemblies are used there depending on whether the movable furniture part to be guided by means of the guide assembly comprises precisely one door leaf or at least two door leaves connected to each other in an articulated manner.

A disadvantage is that the installer has to keep both versions of the guide assembly in stock, unless handling only guide assemblies for one type of the movable furniture part to be guided. Furthermore, the production of the guide assemblies is associated with high costs, as the guide assemblies are formed differently and therefore two production lines are needed.

SUMMARY OF THE INVENTION

The object of the present invention is to avoid these disadvantages at least in part and to specify a method that is improved compared with the state of the art for installing a guide assembly for a movable furniture part, which movable furniture part comprises either precisely one door leaf or at least two door leaves connected to each other in an articulated manner, on a furniture wall of a stationary furniture part. The method gives an installer in particular a greater flexibility in the production of pieces of furniture and is associated with lower production costs on the manufacturer's part. Furthermore, a method for installing a piece of furniture in which the improved method for installing a guide assembly is used is to be specified.

In the method according to the invention for installing a guide assembly for a movable furniture part, which comprises either precisely one door leaf or at least two door leaves connected to each other in an articulated manner, on a furniture wall of a stationary furniture part, the method steps are therefore provided, preferably chronological in the specified sequence:

- a first guide rail for guiding the movable furniture part is arranged on the furniture wall,
- at least one drive device for influencing the movement of the movable furniture part on the furniture wall is arranged on a first elongated side of the first guide rail, preferably wherein the first guide rail and the at least one drive device are connected to each other, particularly preferably in a positive-locking manner, and
- in the case that the movable furniture part comprises at least two door leaves connected to each other in an articulated manner, a second guide rail for guiding the movable furniture part on the furniture wall is arranged on a second elongated side of the first guide rail, preferably wherein the first guide rail and the second guide rail are connected to each other, particularly preferably in a positive-locking manner and/or displaceably.

It is thereby possible to assemble the guide assembly from a type of kit, wherein as many common parts as possible are used, which are used both in the case of a guide assembly for a movable furniture part which comprises precisely one door leaf and in the case of a guide assembly for a movable furniture part which comprises at least two door leaves connected to each other in an articulated manner.

The common parts can be manufactured in larger quantities and on the same production line, as a result of which the costs of the production of the guide assembly are lowered.

According to a preferred embodiment of the method, the same first guide rail and/or the same drive device is involved irrespective of whether the movable furniture part comprises precisely one door leaf or at least two door leaves connected to each other in an articulated manner. As a result, the number of common parts can be increased.

It has proved to be advantageous that, in the case that the movable furniture part comprises precisely one door leaf, in a further method step at least one holding device for holding the movable furniture part in an end position relative to the first guide rail on the furniture wall is arranged on the second elongated side of the first guide rail, preferably wherein the first guide rail and the at least one holding device are connected to each other, particularly preferably in a positive-locking manner and/or displaceably. It is thereby possible to move the movable furniture part into a defined end position relative to the first guide rail by means of the guide assembly, as a result of which the risk of damage originating from a faulty operation of the furniture part is reduced.

As an alternative or supplement, in a further method step a third guide rail for guiding the movable furniture part on the furniture wall is arranged at a distance from the first guide rail. Preferably, the same third guide rail is involved irrespective of whether the movable furniture part comprises precisely one door leaf or at least two door leaves connected to each other in an articulated manner. The movable furniture part can thereby be guided particularly stably on the furniture wall by means of the guide assembly.

A particularly harmonic movement of the movable furniture part to be guided by means of the guide assembly can be produced in that in a further method step at least one damping device for damping a movement of the movable furniture part, preferably into an end position relative to the first guide rail, on the furniture wall is arranged at a distance from the first guide rail. Preferably, the same damping device is involved irrespective of whether the movable furniture part comprises precisely one door leaf or at least two door leaves connected to each other in an articulated manner.

It is favorably suitable that in a further method step at least one carrier for the articulated mounting of the movable furniture part is mounted displaceably on the guide rails provided, preferably wherein the same carrier is involved irrespective of whether the movable furniture part comprises precisely one door leaf or at least two door leaves connected to each other in an articulated manner. The installation is thereby made easier, as the carrier can first be installed on the guide rails provided and then the movable furniture part only has to be connected to the carrier.

In this connection, it has proved to be advantageous that at least one compensation device for compensating for a tilt moment of the at least one carrier or of the movable furniture part arranged thereon about a tilt axis by a restoring moment is arranged on the at least one carrier and in a further method step the at least one compensation device is connected to the furniture wall, preferably to the at least one drive device arranged on the furniture wall. As a result, the risk of a canting of the movable furniture part to be guided by means of the guide assembly can be reduced.

Protection is also sought for a method for installing a piece of furniture with at least one stationary furniture part, at least one movable furniture part, which comprises either precisely one door leaf or at least two door leaves connected to each other in an articulated manner, and at least one guide assembly for the movable furniture part. First, the at least one guide assembly is mounted according to the method according to the invention on a furniture wall of the at least one stationary furniture part, and then the movable furniture part is mounted displaceably at least on the first guide rail, preferably indirectly via at least one carrier.

In an advantageous embodiment, in the case that the movable furniture part comprises at least two door leaves connected to each other in an articulated manner, in a further method step the at least two door leaves are connected to each other in an articulated manner via at least two door hinges.

As an alternative or supplement, in the case that the movable furniture part comprises at least two door leaves connected to each other in an articulated manner, in a further method step at least one transverse guide rail is arranged transverse to the first guide rail on the at least one stationary furniture part and one of the at least two door leaves of the movable furniture part is connected to the at least one transverse guide rail via at least one carriage. The movable furniture part can thereby be guided securely by means of the guide assembly in any position.

In this connection, it has proved to be advantageous that in a further method step the at least one transverse guide rail is covered at least in regions by at least one screen element. An esthetically advantageous appearance of the piece of furniture to be installed can thereby be achieved.

BRIEF DESCRIPTION OF THE DRAWINGS

Further details and advantages of the invention are explained in more detail below by means of the description of the figures with reference to the drawings. There are shown in:

FIG. 6*a* shows a schematically represented perspective view and partial FIG. 6*b* shows a schematically represented side view from behind, wherein a carrier mounted displaceably on the first and second guide rails is additionally represented in partial FIG. 6*b*, FIG. 11*a* shows a schematically represented perspective view and partial FIG. 11*b* shows a schematically represented side view from behind, FIG. 14*a* shows a holding position and partial FIG. 14*b* shows a release position.

DETAILED DESCRIPTION OF THE INVENTION

Figure 1:
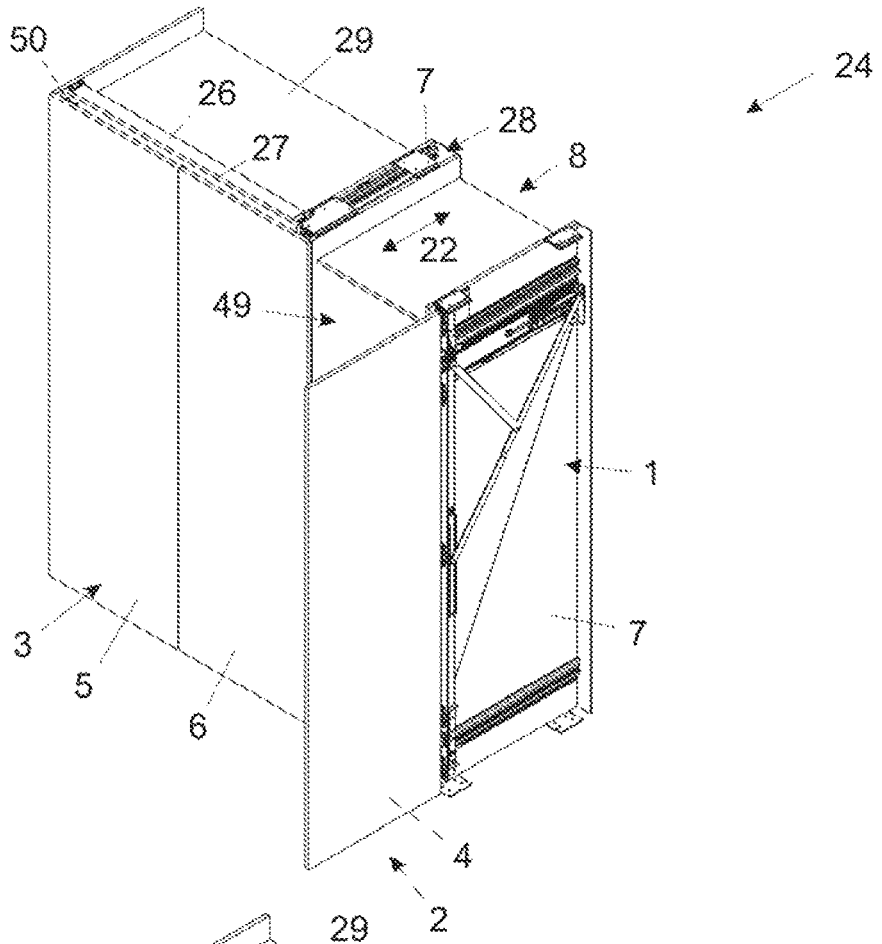
FIG. 1 is a schematically represented perspective view of a piece of furniture with a movable furniture part which comprises precisely one door leaf and a movable furniture part which comprises two door leaves connected to each other in an articulated manner.

FIG. 1 shows a piece of furniture 24 with a movable furniture part 4 which comprises precisely one door leaf 4 and a movable furniture part 3 which comprises two door leaves 5, 6 connected to each other in an articulated manner. In each case an interior 49, in which kitchen appliances and/or kitchen furniture can be arranged for example, can be covered by the movable furniture parts 3, 4. In this way, a concealable kitchen can be produced.

Unlike what is represented in FIG. 1, there can also be a common interior 49 which can be covered from a first side by the movable furniture part 3 and from a second side by the movable furniture part 4.

The piece of furniture 24 comprises cavities 28, which extend in a depth direction 22 of the piece of furniture 24, are preferably formed shaft-shaped and in which the movable furniture parts 3, 4 can be arranged.

In each case, a guide assembly 1 arranged on a furniture wall 7 of a stationary furniture part 8 is installed for guiding the movable furniture parts 3, 4 in the cavities 28.

Figure 2:
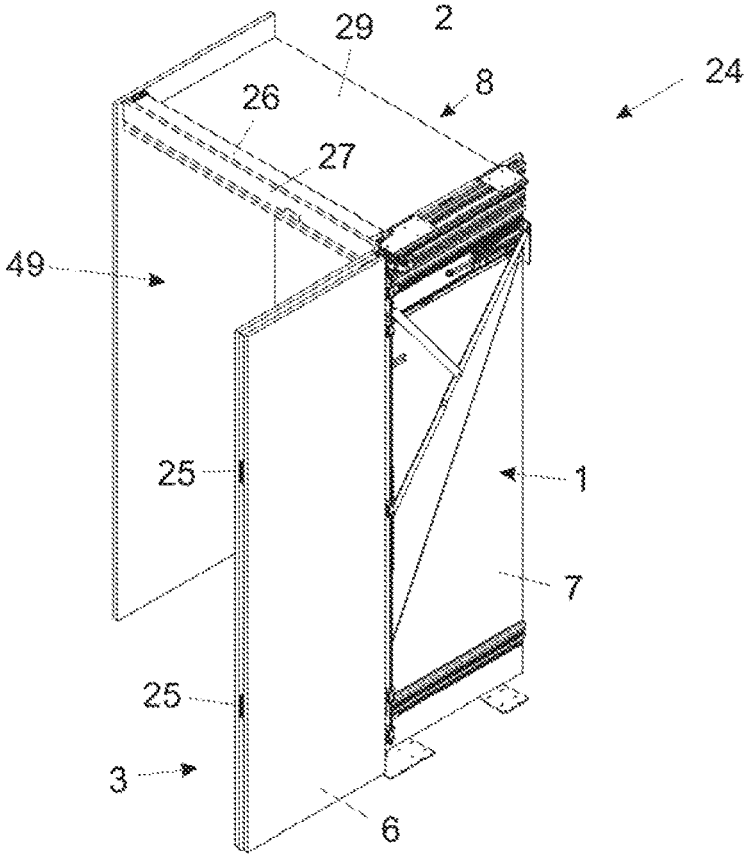
FIG. 2 is a schematically represented perspective view of a piece of furniture with a movable furniture part which comprises two door leaves connected to each other in an articulated manner.

FIG. 2 shows a piece of furniture 24 with a movable furniture part 3 which comprises two door leaves 5, 6 connected to each other in an articulated manner. The door leaves 5, 6 are connected to each other in an articulated manner via door hinges 25.

A transverse guide rail 26 is arranged on a top panel 29 of the piece of furniture 24, wherein one of the two door leaves 5, 6 of the movable furniture part 3 is mounted displaceably on the transverse guide rail 26 via a carriage 50 (cf. also FIG. 1). The transverse guide rail 26 is covered in regions by a screen (fascia) element 27.

In addition to the pieces of furniture 24 represented in FIGS. 1 and 2, pieces of furniture 24 which have only one movable furniture part 4 which comprises precisely one door leaf 4 or pieces of furniture 24 with more than one movable furniture part 3 and/or more than one movable furniture part 4 are also conceivable.

The present invention relates, according to a first aspect, to a method for installing a guide assembly 1 for a movable furniture part 2, 3, which comprises either precisely one door leaf 4 or at least two door leaves 5, 6 connected to each other in an articulated manner, on a furniture wall 7 of a stationary furniture part 8, comprising the following method steps (preferably chronological in the specified sequence).

A first guide rail 9 for guiding the movable furniture part 2, 3 is arranged on the furniture wall 7, and at least one drive device 11 for influencing the movement of the movable furniture part 2, 3 on the furniture wall 7 is arranged on a first elongated side 10 of the first guide rail 9. Preferably, the first guide rail 9 and the at least one drive device 11 are connected to each other, particularly preferably in a positive-locking manner. If the movable furniture part 3 comprises at least two door leaves 5, 6 connected to each other in an articulated manner, a second guide rail 13 for guiding the movable furniture part 3 on the furniture wall 7 is arranged on a second elongated side 12 of the first guide rail 9. Preferably, the first guide rail 9 and the second guide rail 13 are connected to each other, particularly preferably in a positive-locking manner and/or displaceably.

A preferred embodiment of this method for installing a guide assembly 1 for a movable furniture part 3, which comprises at least two door leaves 5, 6 connected to each other in an articulated manner, on a furniture wall 7 of a stationary furniture part 8 is described below with reference to FIGS. 3 to 8. A preferred embodiment of the method for installing a guide assembly 1 for a movable furniture part 2, which comprises precisely one door leaf 4, on a furniture wall 7 of a stationary furniture part 8 is then described with reference to FIGS. 9 to 14*b*).

Figure 3:
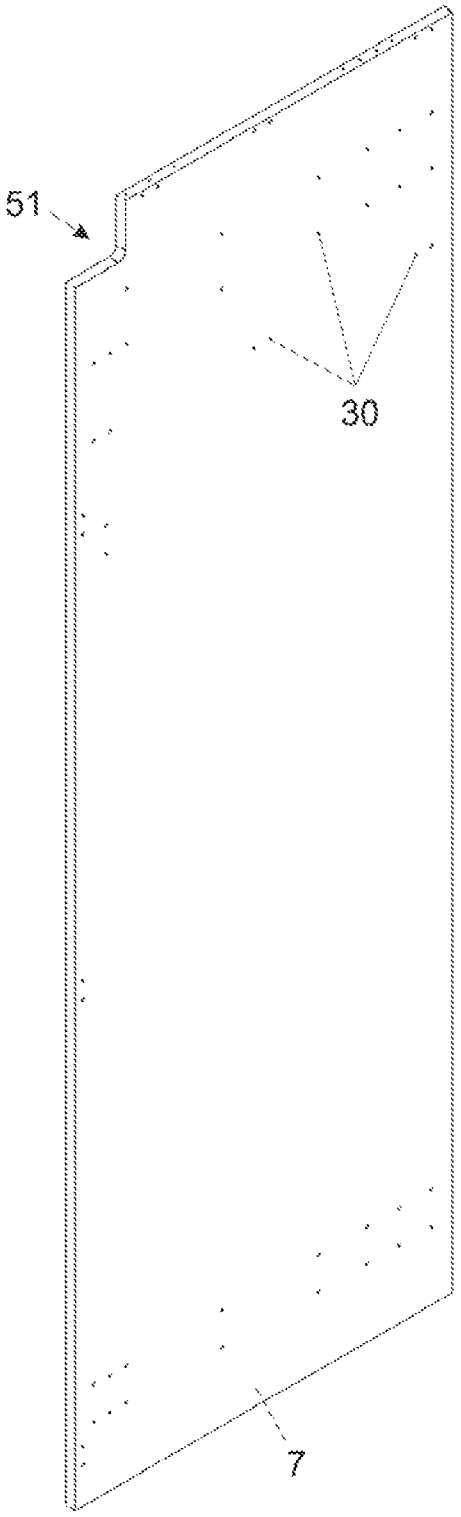
FIG. 3 is a schematically represented perspective view of a furniture wall of a stationary furniture part of a piece of furniture with a movable furniture part which comprises at least two door leaves connected to each other in an articulated manner.

FIG. 3 shows a furniture wall 7 of a stationary furniture part 8 of a piece of furniture 24, wherein a guide assembly for a movable furniture part 3 which comprises at least two door leaves 5, 6 connected to each other in an articulated manner is to be installed on the furniture wall 7. Drilled holes 30 are arranged in the furniture wall 3. Moreover, the furniture wall 7 has a cutout 51.

Figure 4:
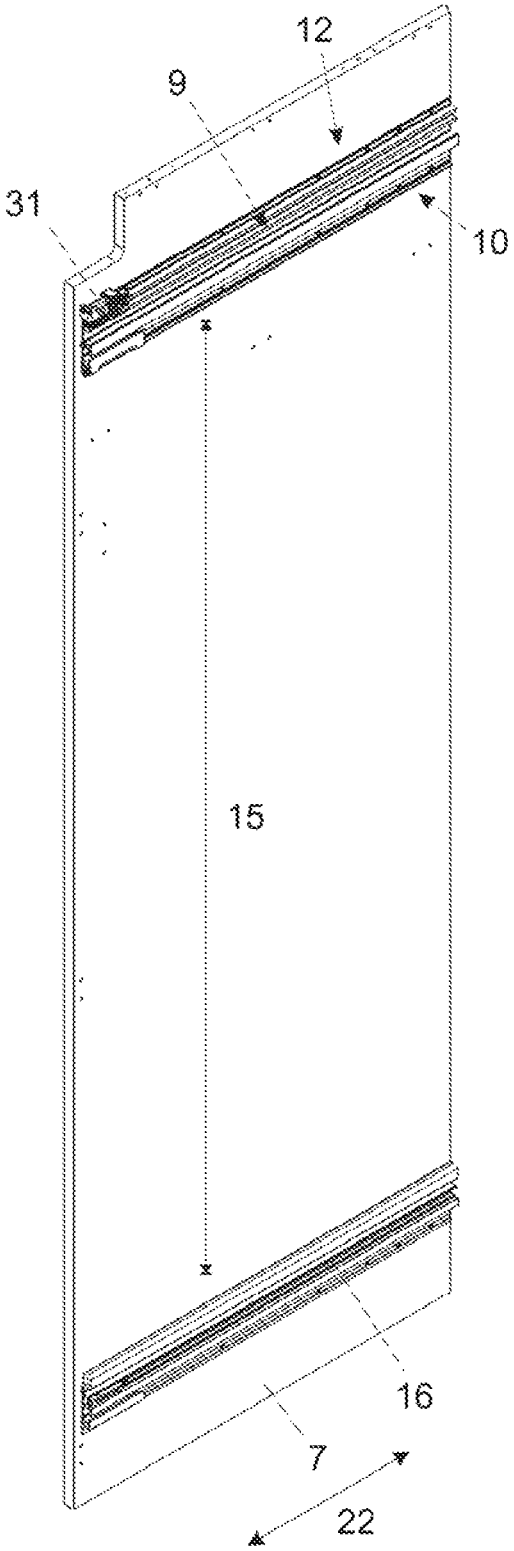
FIG. 4 shows the furniture wall according to FIG. 3 with a first and a third guide rail.

FIG. 4 shows the furniture wall 3 according to FIG. 3, wherein a first (upper) guide rail 9 and a third (lower) guide rail 16 are arranged on the furniture wall 7.

The third (lower) guide rail 16 is arranged at a distance 15 from the first (upper) guide rail 9.

The first guide rail 9 has an adjusting device 31, with which a second (upper) guide rail 13 arranged on the second elongated side 12 of the first guide rail 9 (cf. FIG. 5) can be adjusted in the depth direction 22 of the furniture wall 7.

Figure 5:
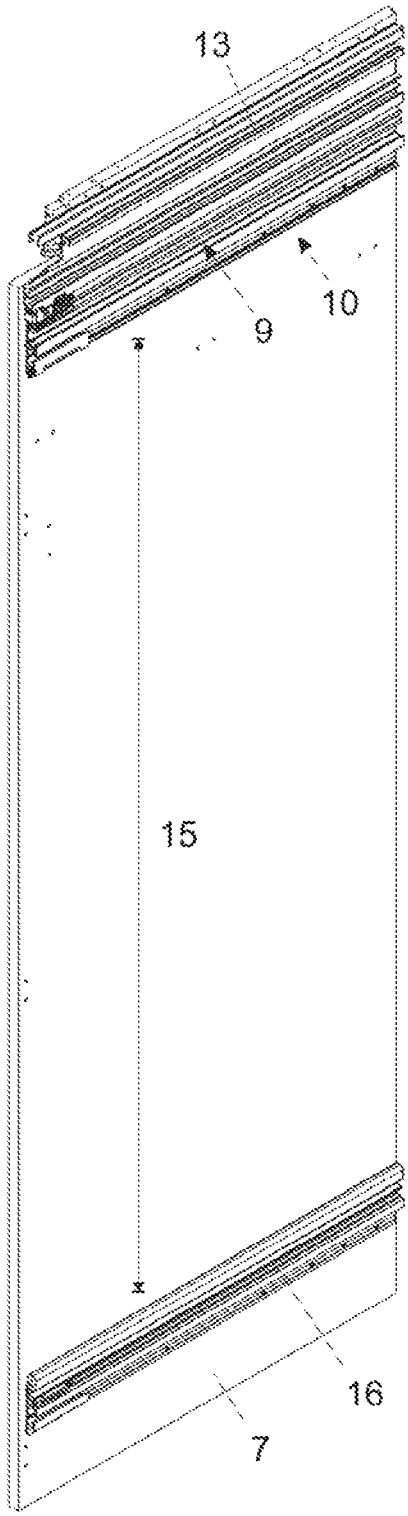
FIG. 5 shows the furniture wall according to FIG. 4, additionally with a second guide rail.

FIG. 5 shows the furniture wall 7 according to FIG. 4 additionally with a second guide rail 13, wherein the second guide rail 13 is arranged on the second elongated side 12 of the first guide rail 9 on the furniture wall 7.

The first (upper) guide rail 9 and the second (upper) guide rail 13 are connected to each other in a positive-locking manner and displaceably (cf. also FIG. 6*b*)).

Figure 6A:
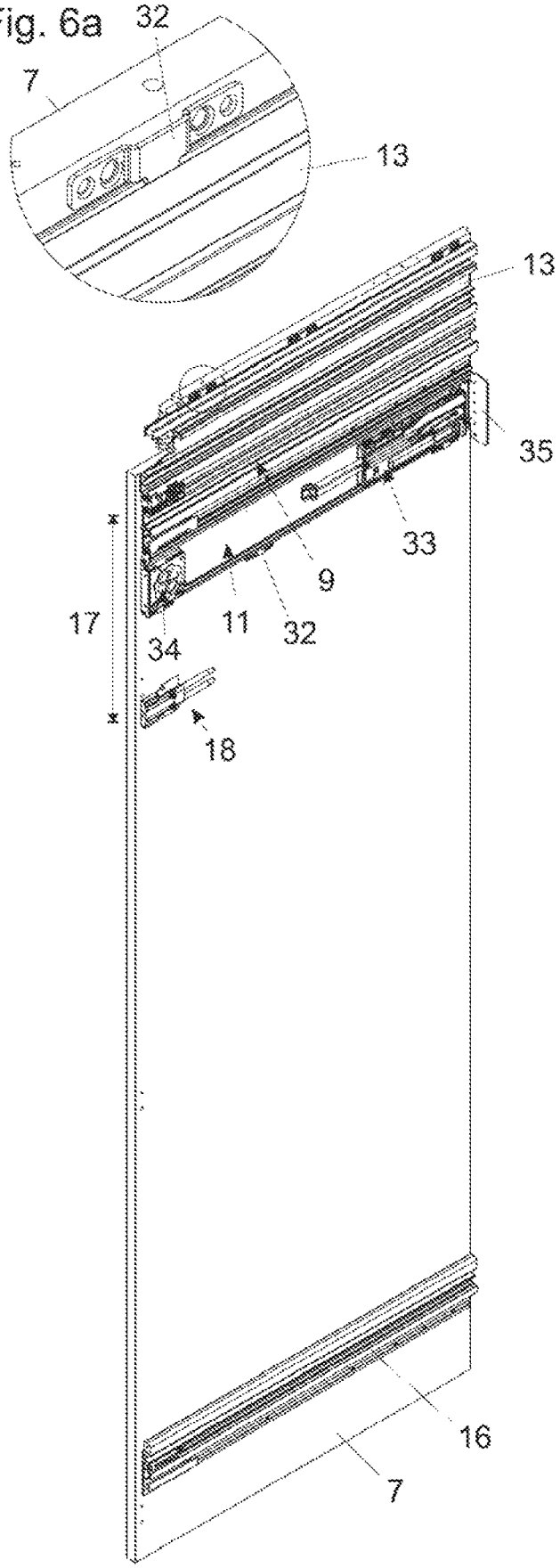
FIGS. 6*a*, 6*b* show the furniture wall according to FIG. 5 additionally with a drive device and a damping device, wherein partial
Figure 6B:
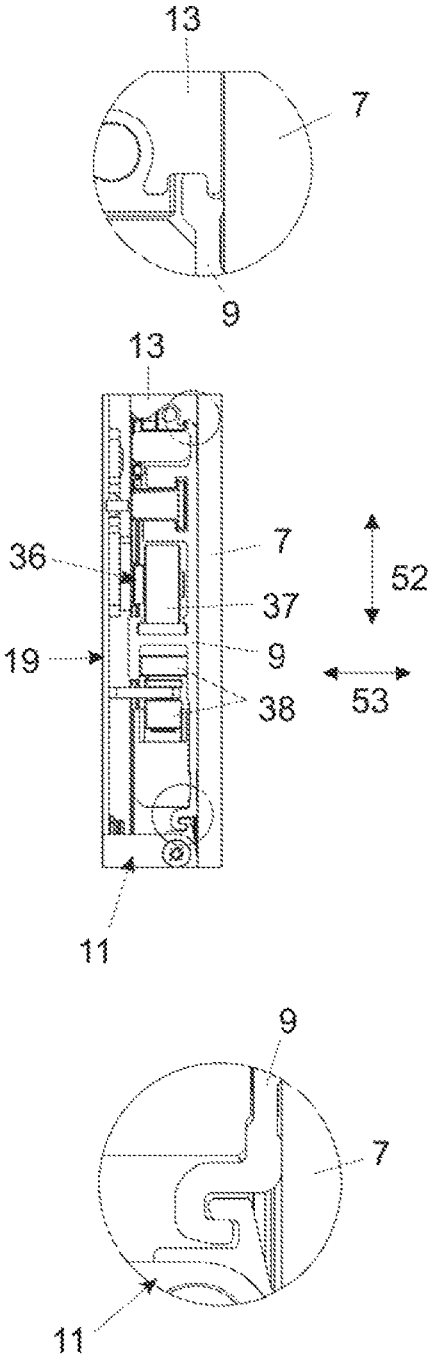

FIGS. 6*a* and 6*b* show the furniture wall 7 according to FIG. 5 additionally with a drive device 11 and a damping device 18. A carrier 19 mounted displaceably on the first guide rail 9 and the second guide rail 16 is additionally represented in FIG. 6*b*.

The drive device 11 for influencing the movement of the movable furniture part 3 is arranged on the first elongated side 10 (cf. FIG. 5) of the first guide rail 9, and the first guide rail 9 and the drive device 11 are connected to each other in a positive-locking manner (cf. FIG. 6*b*).

Different embodiments of the drive device 11 are possible. The drive device 11 can be formed in such a way that it speeds up, slows down, and/or uniformly moves the movable furniture part 3. The movement can be influenced over the entire route between an arrangement of the movable furniture part 3 outside a cavity 28 formed with the furniture wall 7 (cf. FIG. 1) and an arrangement of the movable furniture part 3 in an end position inside the cavity 28 formed with the furniture wall 7. Alternatively, the movement can be influenced only over one or more partial sections of this route.

In the case represented specifically, the drive device 11 comprises an ejection device 33 for ejecting the movable furniture part 3 from an end position of the movable furniture part 3 relative to the furniture wall 7. Furthermore, a cable pull 34 is provided, with which the movable furniture part 3 is movable along the first guide rail 9 from a first end position into a second end position. The application of force by the ejection device 33 and the cable pull 34 overlap each other in such a way that the movable furniture part 3 is movable from the first end position into the second end position without power assistance by a user. During a movement in the opposite direction, the ejection device 33 and the cable pull 34 are loaded again.

A holder 35 is arranged in an end-side region of the drive device 11. The function of this holder 35 is described in connection with FIG. 8.

The damping device 18 for damping a movement of the movable furniture part 3 is arranged at a distance 17 from the first guide rail 9 on the furniture wall 7.

In the case represented specifically, the damping device 18 is arranged on the furniture wall 7 in such a way that a movement of the movable furniture part 3 into an end position relative to the first guide rail 9 can be damped.

As apparent from the enlarged sections of FIG. 6*a*, the second guide rail 13 is fastened on the one hand to the first guide rail 9 in a positive-locking manner, and on the other hand on the furniture wall 7 via holding elements 32. The fastenings make it possible to displace the second guide rail 13 relative to the first guide rail 9 by the adjusting device 31 (cf. FIG. 4).

The fastening of the drive device 11 on the one hand on the first guide rail 9 and on the other hand on the furniture wall 7 via holding elements 32 can be effected analogously, wherein a relative displaceability of the drive device 11 and the first guide rail 9 is, however, not provided.

As apparent from FIG. 6*b*, the carrier 19 is connected to the first guide rail 9 via a guide device 36. The guide device 36 comprises carrying rollers 37, via which the weight of the carrier 19 and of the movable furniture part 3 that is or can be connected to the carrier 19 can be supported in the vertical direction 52, and supporting rollers 38, with which the carrier 19 can be supported in the horizontal direction 53.

Figure 7:
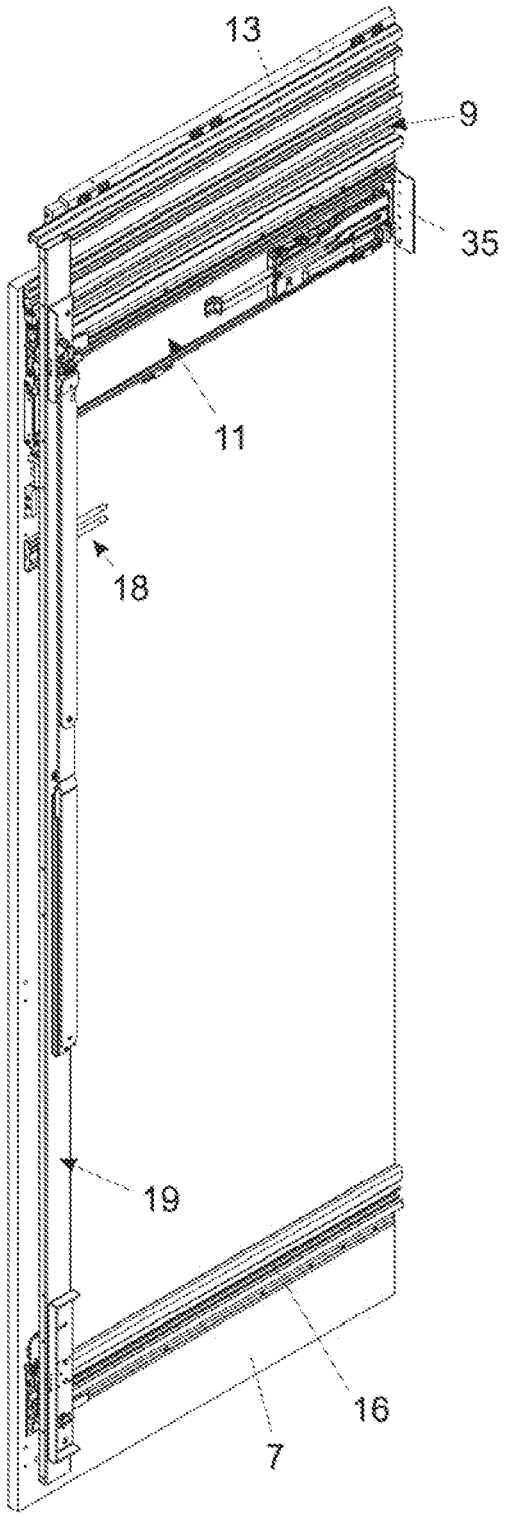
FIG. 7 shows the furniture wall according to FIG. 6*a* additionally with a carrier.

FIG. 7 shows the furniture wall 7 according to FIG. 6*a* additionally with a carrier 19.

The carrier 19 for the articulated mounting of the movable furniture part 3 is mounted displaceably on the guide rails 9, 13, 16 provided. A compensation device 20 for compensating for a tilt moment 21 of the at least one carrier 19 or of the movable furniture part 3 arranged thereon about a tilt axis by applying a restoring moment 23 is arranged on the carrier 19.

Figure 8:
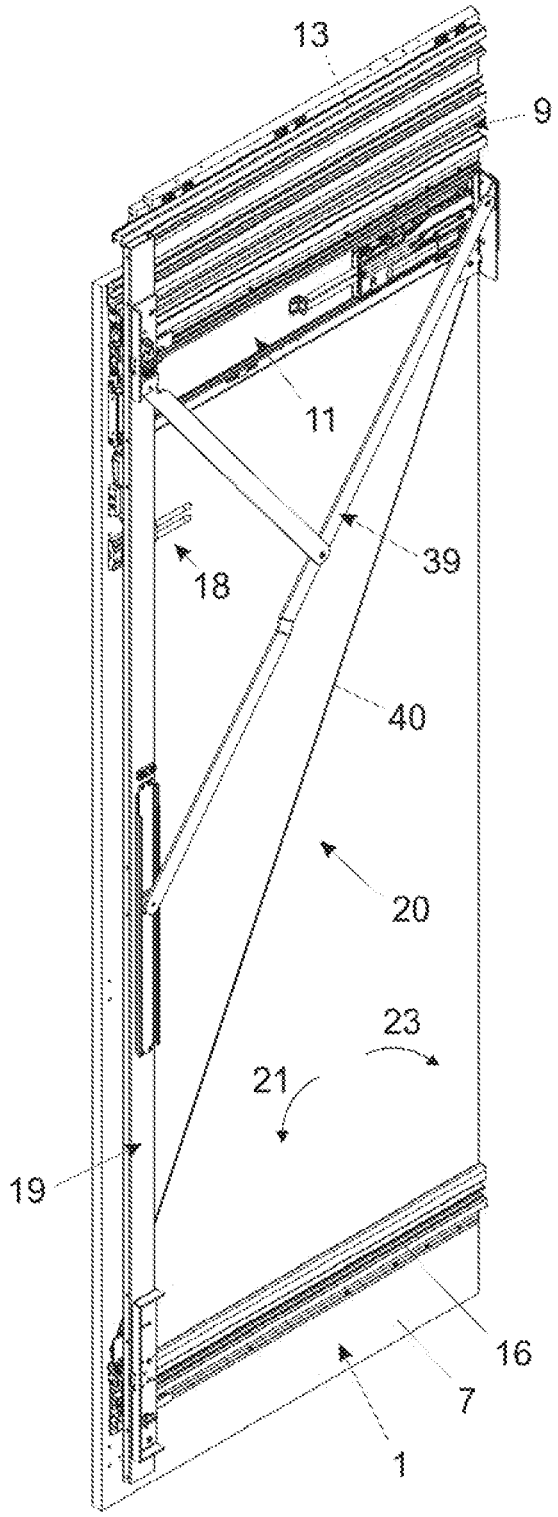
FIG. 8 shows the furniture wall according to FIG. 7, wherein a compensation device arranged on the carrier is connected to the drive device.
Figure 9:
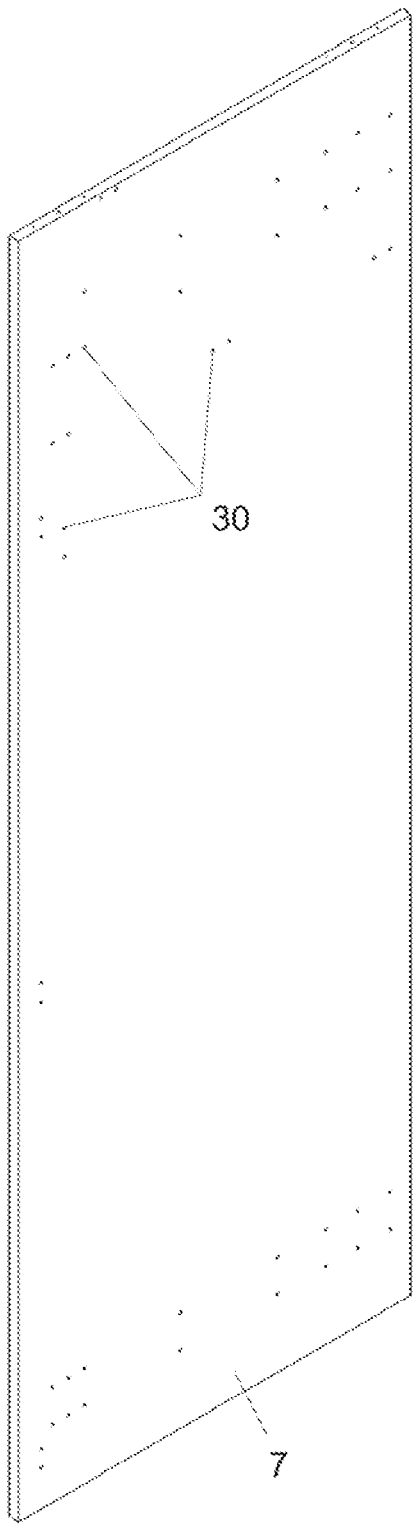
FIG. 9 is a schematically represented perspective view of a furniture wall of a stationary furniture part of a piece of furniture with a movable furniture part which comprises precisely one door leaf.
Figure 10:
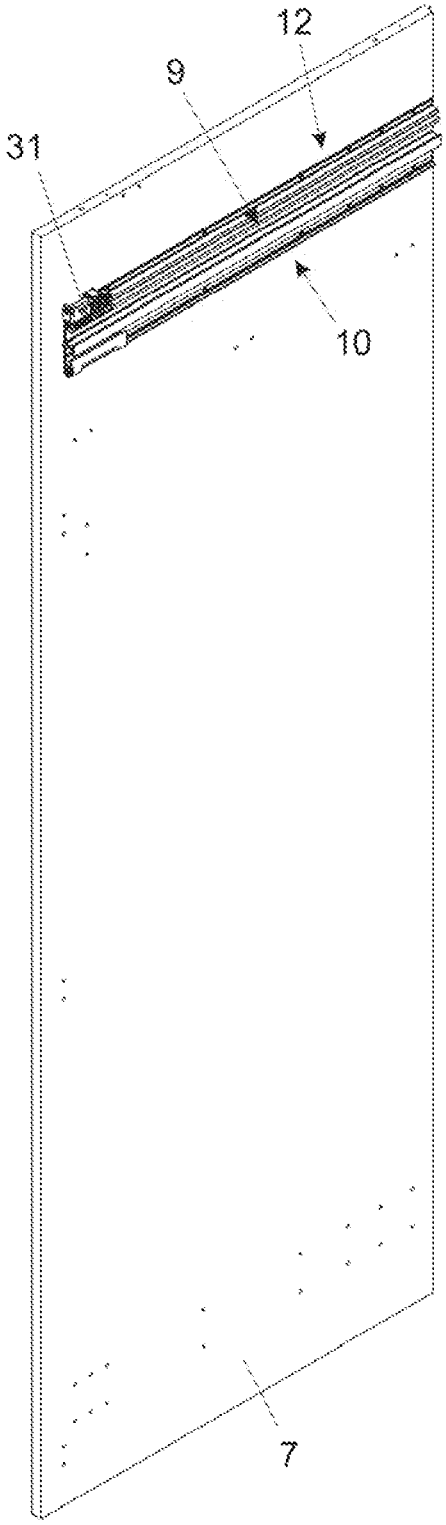
FIG. 10 shows the furniture wall according to FIG. 9 with a first guide rail.
Figure 11A:
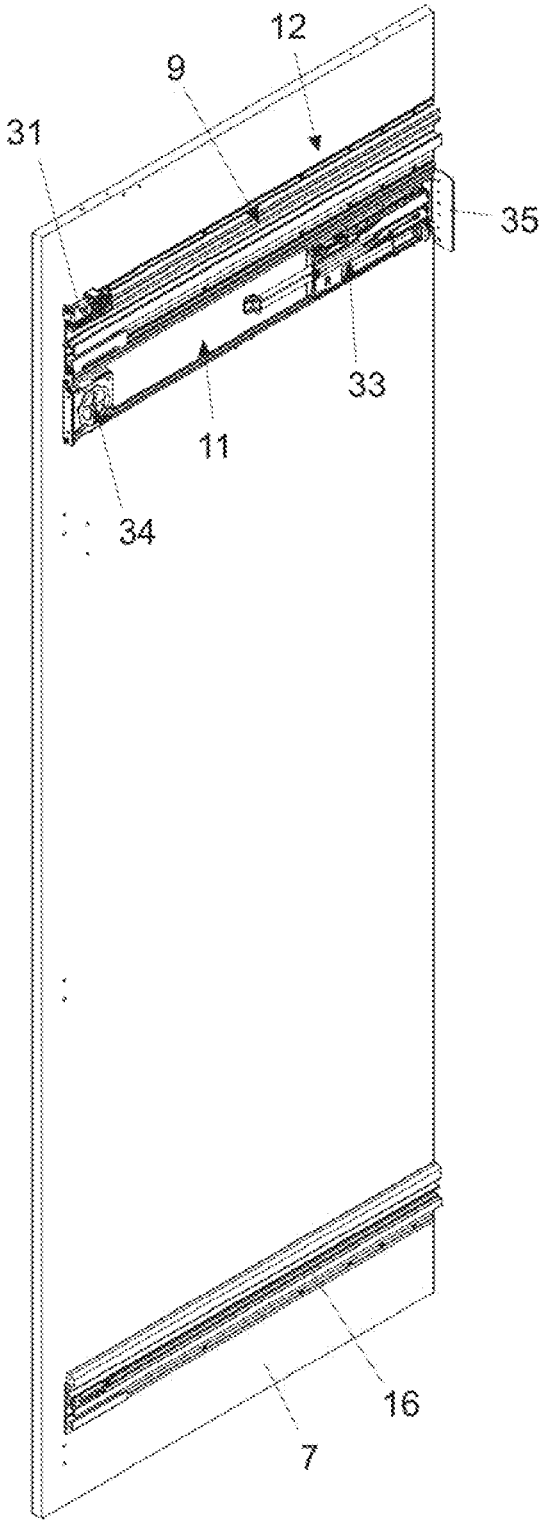
FIGS. 11*a*, 11*b* show the furniture wall according to FIG. 10 additionally with a drive device, wherein partial
Figure 11B:
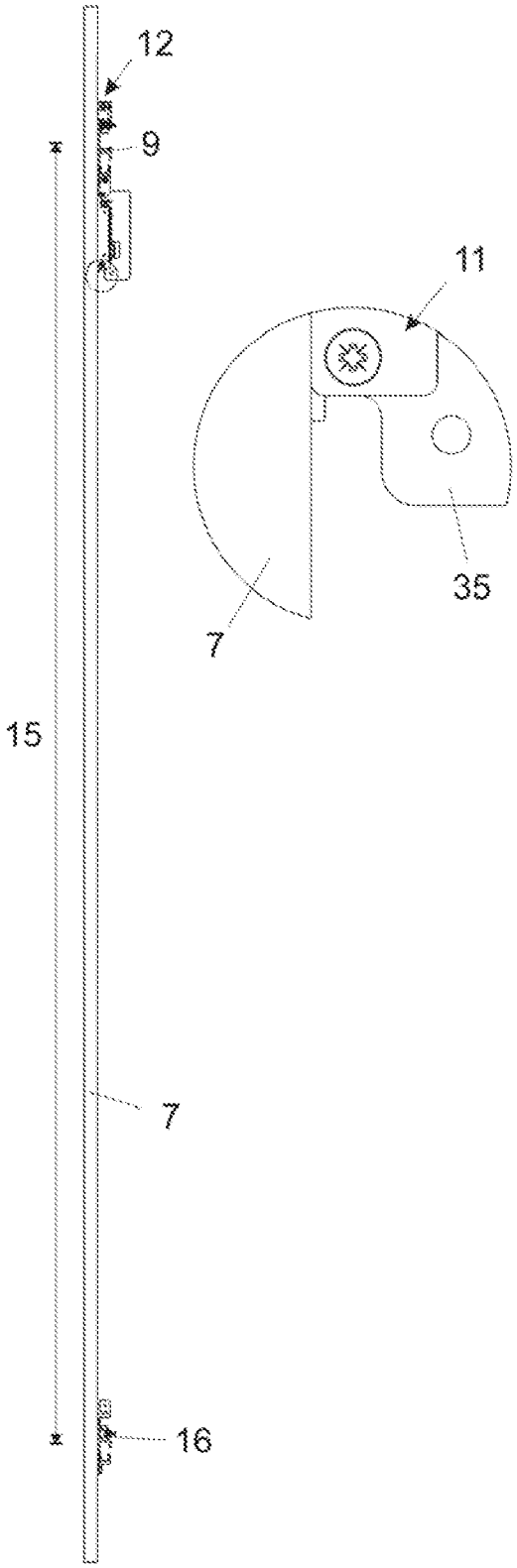
Figure 12A:
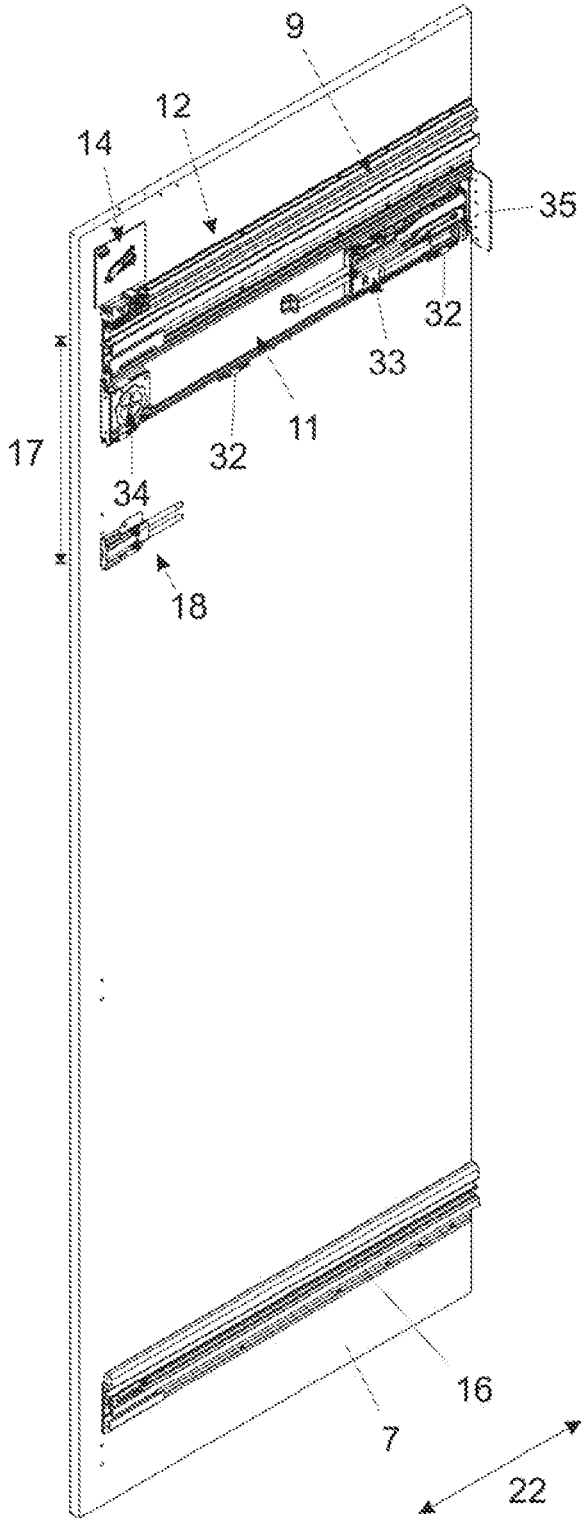
FIG. 12*a* shows the furniture wall according to FIG. 11*a* additionally with a damping device, a third guide rail and a holding device.
Figure 12B:
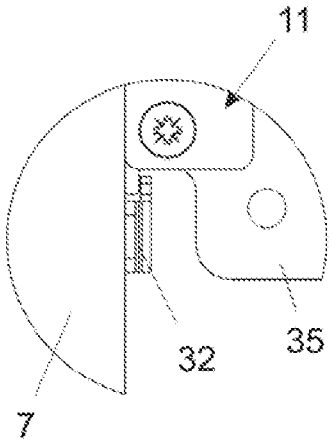
FIG. 12*b* is the enlarged view from FIG. 11*b*, wherein the drive device is fastened on the furniture wall via a holding element.

In FIG. 8, the compensation device 20 is connected to the drive device 11, specifically to the holder 35 of the drive device 11.

Different embodiments of the compensation device 20 are possible. In the case represented specifically, the compensation device 20 comprises a scissor mechanism 39 formed Y-shaped and a cable device 40 with a pulling cable running in the shape of a Z.

The chronological sequence during the installation of the guide assembly 1 on the furniture wall 7 can be defined as follows:

1. the furniture wall 7 is provided
2. the first guide rail 9 is arranged on the furniture wall 7
3. the third guide rail 16 is arranged on the furniture wall 7
4. the second guide rail 13 is arranged on the furniture wall 7
5. the drive device 11 is arranged on the furniture wall 7
6. the damping device 18 is arranged on the furniture wall 7
7. the carrier 19 is mounted displaceably on the guide rails 9, 16, 13
8. the compensation device 20 is connected to the furniture wall 7 and/or the drive device 11.

The preferred embodiment, illustrated with reference to FIGS. 9 to 14*b*, of the method for installing a guide assembly 1 for a movable furniture part 2 which comprises precisely one door leaf 4 proceeds substantially analogously to the preferred embodiment, represented in FIGS. 3 to 8, of the method for installing a guide assembly 1 for a movable furniture part 3 which comprises at least two door leaves 5, 6 connected to each other in an articulated manner.

As a comparison shows, common parts can be used here. Thus, the same first guide rail 9, the same drive device 11, the same damping device 18, and the same carrier 19 are involved irrespective of whether the movable furniture part 2, 3 comprises precisely one door leaf 4 or at least two door leaves 5, 6 connected to each other in an articulated manner.

A difference between the two embodiments is that in a further method step, at least one holding device 14 for holding the movable furniture part 2 in an end position relative to the first guide rail 9 on the furniture wall 7 is arranged on the second elongated side 12 of the first guide rail 9 (instead of the second guide rail 13). Preferably, the first guide rail 9 and the at least one holding device 14 are connected to each other, particularly preferably in a positive-locking manner and/or displaceably.

The holding device 14 can likewise be adjustable in the depth direction 22 of the furniture wall 7 relative to the first guide rail 9 via an adjusting device 31.

Figure 14A:
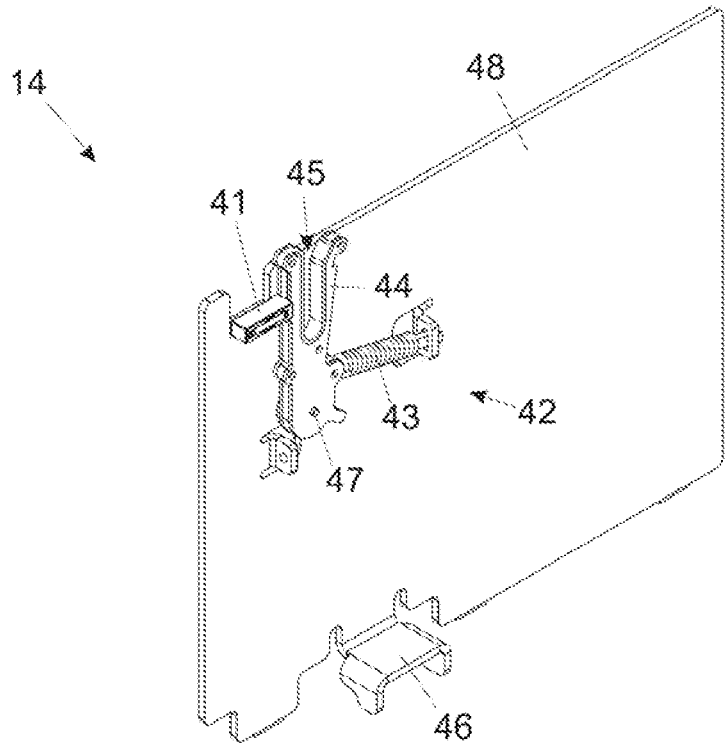
FIGS. 14*a*, 14*b* are, in each case, a schematically represented perspective view of a holding device for holding a movable furniture part which comprises precisely one door leaf, wherein partial
Figure 14B:
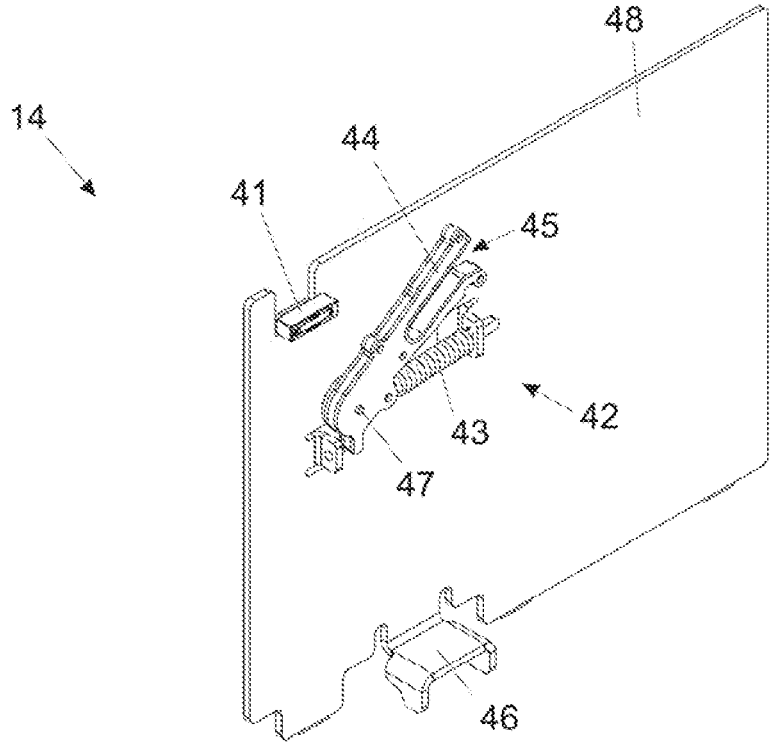

Different embodiments of the holding device 14 are possible. A preferred embodiment is shown in FIGS. 14*a* and 14*b*, wherein FIG. 14*a* shows a holding position and FIG. 14*b* shows a release position.

The holding device 14 comprises a pivot lever mechanism 42 with a pivot lever 44 mounted rotatably about a pivot pin 47 on a base body 48. The pivot lever 44 is pushed into the two end positions shown in FIGS. 14*a* and 14*b* via a spring device 43. A dead center position is formed between these positions. A stop 41 is provided, against which the pivot lever 44 rests in the end position according to FIG. 14*a*.

The pivot lever 44 has a receiver 45, into which a bolt or the like can be inserted, and the bolt is or can be connected to the movable furniture part 2 in a movement-coupled manner. In the end position according to FIG. 14*a*, the bolt, and thus the movable furniture part 2, is held by the spring-loaded pivot lever 44. If a user wishes to move the movable furniture part 2 out of this end position, they have to overcome the spring force of the spring device 43. The pivot lever 44 is moved beyond the dead center position and into the end position according to FIG. 14*b*. The bolt and thus the movable furniture part 2 are released.

On the base body 48, a coupling element 46 is provided which is in or can be brought into engagement with the adjusting device 31, as a result of which the base body 48, and thus the entire holding device 14, is displaceable relative to the first guide rail 9.

Figure 13:
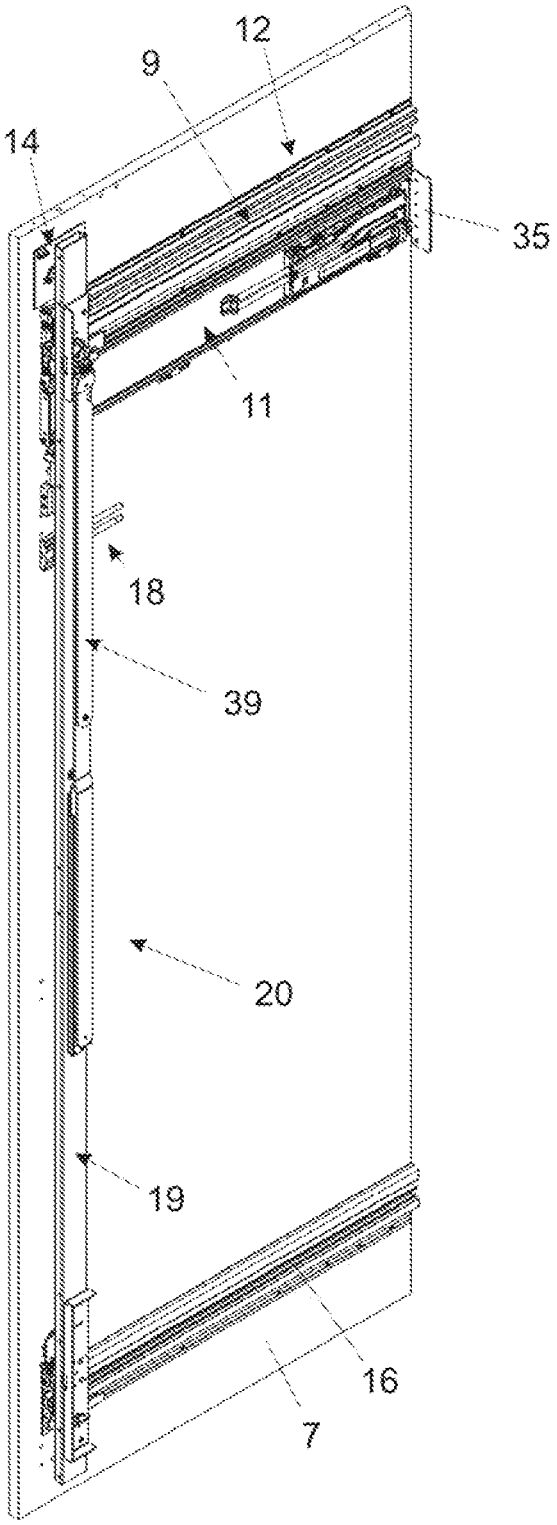
FIG. 13 shows the furniture wall according to FIG. 12*a* additionally with a carrier.

It may still be pointed out that the compensation device 20 arranged on the carrier 19 is connected to the furniture wall 7 or the drive device 11 in exactly the same way as in the preferred embodiment in FIGS. 3 to 8 still starting from FIG. 13 (analogously to FIG. 8).

The method for installing a guide assembly 1 can be incorporated in a method for installing a piece of furniture 24, with which the pieces of furniture 24 represented in FIG. 1 or 2 for example can be installed.

Specifically, it is a method for installing a piece of furniture 24 with at least one stationary furniture part 8, at least one movable furniture part 2, 3, which comprises either precisely one door leaf 4 or at least two door leaves 5, 6 connected to each other in an articulated manner, and at least one guide assembly 1 for the movable furniture part 2, 3. First, the at least one guide assembly 1 is mounted according to the method according to the invention on a furniture wall 7 of the at least one stationary furniture part 8, and then the movable furniture part 2, 3 is mounted displaceably at least on the first guide rail 9, preferably indirectly via at least one carrier 19.

In the case that the movable furniture part 3 comprises at least two door leaves 5, 6 connected to each other in an articulated manner, in a further method step the at least two door leaves 5, 6 are connected to each other in an articulated manner via at least two door hinges 25 (cf. FIG. 2).

In the case that the movable furniture part 3 comprises at least two door leaves 5, 6 connected to each other in an articulated manner, in a further method step at least one transverse guide rail 26 is arranged transverse to the first guide rail 9 on the at least one stationary furniture part 8, and one of the at least two door leaves 5, 6 of the movable furniture part 3 is connected to the at least one transverse guide rail 26 via at least one carriage 50 (cf. FIG. 2).

In a further method step, the at least one transverse guide rail 26 is covered at least in regions (at least partially) by at least one screen (fascia) element 27.

The invention claimed is:

1. A method for installing a guide assembly for a movable furniture part on a furniture wall of a stationary furniture part, the movable furniture part including either precisely one door leaf or at least two door leaves connected to each other in an articulated manner, the method comprising:

arranging a first guide rail on the furniture wall for guiding the movable furniture part, the first guide rail having a first side and a second side opposite the first side;

arranging a drive device on the first side of the first guide rail for influencing a movement of the movable furniture part on the furniture wall;

mounting a carrier displaceably on the first guide rail for allowing articulated mounting of the movable furniture part to the first guide rail;

arranging a compensation device on the carrier to compensate for a tilt moment of the carrier or a tilt moment of the movable furniture part mounted on the carrier about a tilt axis by a restoring moment, the compensation device including a Y-shaped scissor mechanism and a cable device with a cable extending in a Z shape; and connecting the compensation device to the furniture wall;

wherein when the movable furniture part includes the at least two door leaves connected to each other in an articulated manner, arranging a second guide rail on the second side of the first guide rail for guiding the movable furniture part on the furniture wall.

2. The method according to claim 1, wherein the first guide rail is the same type of first guide rail irrespective of whether the movable furniture part comprises precisely one door leaf or at least two door leaves connected to each other in an articulated manner.

3. The method according to claim 2, wherein the drive device is the same type of drive device irrespective of whether the movable furniture part comprises precisely one door leaf or at least two door leaves connected to each other in an articulated manner.

4. The method according to claim 1, wherein, when the movable furniture part comprises precisely one door leaf, the method further comprises arranging a holding device on the second side of the first guide rail for holding the movable furniture part in an end position relative to the first guide rail on the furniture wall.

5. The method according to claim 4, wherein the first guide rail and the holding device are connected to each other in a positive-locking manner.

6. The method according to claim 5, wherein the first guide rail and the holding device are displaceably connected to each other.

7. The method according to claim 4, wherein the first guide rail and the holding device are displaceably connected to each other.

8. The method according to claim 1, further comprising arranging a third guide rail on the furniture part at a distance from the first guide rail for guiding the movable furniture part.

9. The method according to claim 8, wherein the third guide rail is the same type of third guide rail irrespective of whether the movable furniture part comprises precisely one door leaf or at least two door leaves connected to each other in an articulated manner.

10. The method according to claim 1, further comprising arranging a damping device on the furniture wall at a distance from the first guide rail for damping a movement of the movable furniture part.

11. The method according to claim 10, wherein the damping device is arranged at an end position of the first guide rail, and the damping device is the same type of damping device irrespective of whether the movable furniture part comprises precisely one door leaf or at least two door leaves connected to each other in an articulated manner.

12. The method according to claim 1, wherein the carrier is the same type of carrier irrespective of whether the movable furniture part comprises precisely one door leaf or at least two door leaves connected to each other in an articulated manner.

13. The method according to claim 12, wherein the compensation device is connected to the drive device arranged on the furniture wall.

14. A method of assembling a piece of furniture including a stationary furniture part, a movable furniture part, the movable furniture part comprising either precisely one door leaf or at least two door leaves connected to each other in an articulated manner, and a guide assembly for the movable furniture part, the method comprising first mounting the guide assembly on a furniture wall of the stationary furniture part using the method according to claim 1, and then displaceably mounting the movable furniture part on the first guide rail.

15. The method according to claim 14, wherein, when the movable furniture part comprises at least two door leaves connected to each other in an articulated manner, the method further comprising connecting the at least two door leaves to each other in an articulated manner via at least two door hinges.

16. The method according to claim 14, wherein, when the movable furniture part comprises at least two door leaves connected to each other in an articulated manner, the method further comprising arranging a transverse guide rail transverse to the first guide rail on the stationary furniture part, and connecting a first one of the at least two door leaves of the movable furniture part to the transverse guide rail via a carriage.

17. The method according to claim 16, further comprising covering the transverse guide rail at least partially by a fascia element.

18. The method according to claim 16, wherein the steps of:

arranging the first guide rail on the furniture wall;

arranging the drive device on the first side of the first guide rail; and when the movable furniture part includes the at least two door leaves connected to each other in an articulated manner, arranging the second guide rail on the second side of the first guide rail, are performed in sequence and order as recited.

19. The method according to claim 14, wherein the movable furniture part is displaceably mounted on the first guide rail indirectly via the carrier.

20. The method according to claim 1, wherein the first guide rail and the drive device are connected to each other in a positive-locking manner.

21. The method according to claim 1, wherein the first guide rail and the second guide rail are connected to each other in a positive-locking manner.

22. The method according to claim 21, wherein the first guide rail and the second guide rail are displaceably connected to each other.

23. The method according to claim 1, wherein the first guide rail and the second guide rail are displaceably connected to each other.

24. The method according to claim 1, wherein the drive device is the same type of drive device irrespective of whether the movable furniture part comprises precisely one door leaf or at least two door leaves connected to each other in an articulated manner.

* * * * *